United States Patent [19]

Marković et al.

[11] Patent Number: 4,679,238

[45] Date of Patent: Jul. 7, 1987

[54] METHOD AND SYSTEM FOR SIGNALLING ADDITIONAL INFORMATION BY AM MEDIUM WAVE BROADCASTING

[75] Inventors: A. Marković, Belgrade; M. Temerinac, Novisad, both of Yugoslavia; Peter Braegas, Hildesheim, Fed. Rep. of Germany

[73] Assignee: Blaupunkt Werke GmbH, Hildesheim, Fed. Rep. of Germany

[21] Appl. No.: 727,371

[22] Filed: Apr. 25, 1985

[51] Int. Cl.[4] ..... H04H 5/00

[52] U.S. Cl. ..... 381/16; 381/15

[58] Field of Search ..... 370/11; 329/112; 381/4, 381/15, 16; 332/23 R, 23 A

[56] References Cited

U.S. PATENT DOCUMENTS 4,388,493 6/1983 Maisel ..... 381/4

4,420,658 12/1983 Loughlin ..... 381/15

4,489,411 12/1984 Snedkund ..... 381/16

4,534,054 8/1985 Maisel ..... 381/4

*Primary Examiner*—Forester W. Isen

*Attorney, Agent, or Firm*—Frishauf, Holtz, Goodman & Woodward

[57] ABSTRACT

To permit transmission of traffic information by amplitude modulation in the medium wave band without disturbing audio signals being broadcast, a stereo pilot tone of frequency $f_{pt}$ below audible range is generated, as well as first and second sinusoidal signals of $f_1 = m_1/n \cdot f_{pt}$ and $f_2 = m_2/n \cdot f_{pt}$, in which $m_1$, $m_2$, and n are different integers. The carrier is modulated by the stereo pilot tone and the first and second sinusoidal signals in such a manner that the phases thereof are different and further, when added, they do not essentially exceed the amplitude of the stereo pilot tone.

23 Claims, 7 Drawing Figures

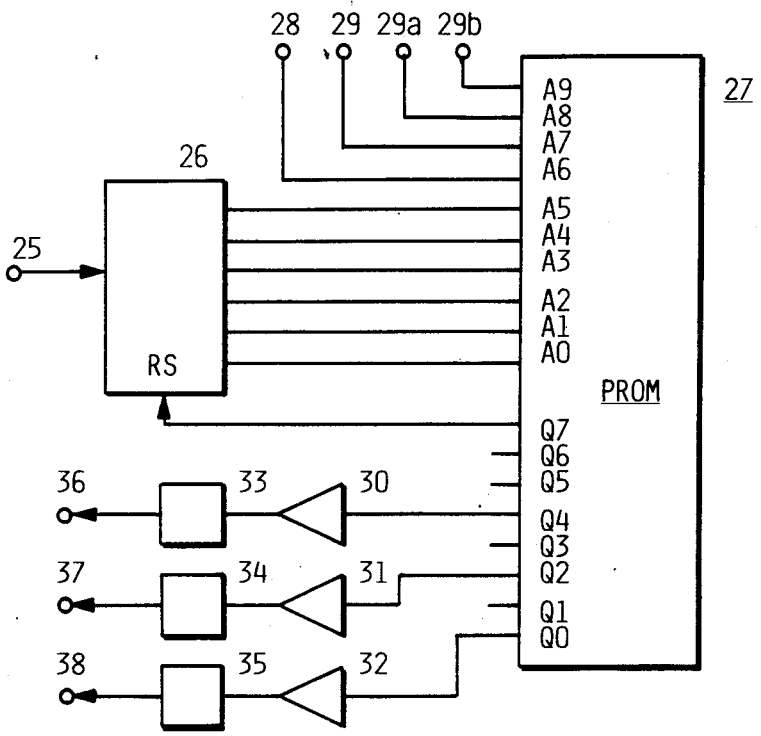
FIG. 2B
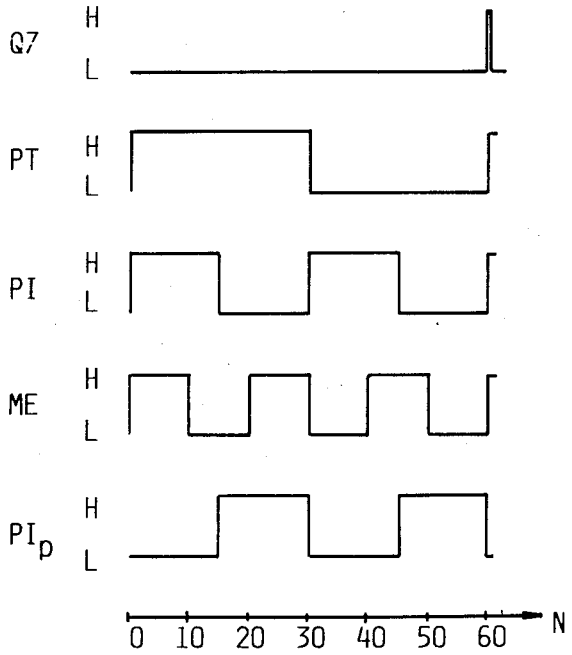

METHOD AND SYSTEM FOR SIGNALLING ADDITIONAL INFORMATION BY AM MEDIUM WAVE BROADCASTING

The present invention relates to signalling by radio and particularly to a transmission-reception system and method and transmitters and receivers therefor.

BACKGROUND

Several European countries widely use frequency modulation (FM) broadcasting networks for road traffic information. Additional recognition signals are superimposed on the broadcast signals which include audio signals and, in case of stereo broadcasting, stereo pilot signals, in order to indicate road traffic information service. Several different signals are used; see U.S. Pat. No. 3,949,401 Hegeler et al Apr. 6, 1976; U.S. Pat. No. 4,435,843 Eilers and Brägas Mar. 3, 1984; U.S. Pat. No. 4,450,589 Eilers and Brägas May 22, 1984; U.S. Pat. No. 319,653 filed Nov. 9, 1981 Eilers and Brägas continuation application Ser. No. 690,840, filed Jan. 14, 1985, now U.S. Pat. No. 4,584,708, issued Apr. 22, 1986.

In the FM systems, a first signal is transmitted continuously if a radio station provides traffic information service. Responding on this first signal an indication lamp or the audio channel in the receiver is switched on. Thus, when tuning a receiver a car driver can recognize whether a station will transmit traffic information. This signal is also called "program identification" signal "PI" signal for short.

A second signal also termed an announcement recognition signal, is transmitted during the traffic information service message. The second, or AR signal, indicates that a message or an announcement is being transmitted, in contrast to other program contents. This signal is also called "message signal", "ME" signal for short. By means of this AR signal the volume of the receiver can be increased or the receiver can be switched over from tape reproduction to radio reception.

A third signal is transmitted continuously in order to identify the station, area, or the region in which the station provides traffic information service. Therefore this signal is called radio station or region recognition signal or RR signals.

The transmission of these additional signals has to be compatible with the established mono and stereo broadcasting systems. That means the additional signals must not interfere with the audio signals and the pilot one in case of stereo and vice versa. Furthermore the additional signals must not exceed the frequency band and amplitude limits allowed for broadcast transmitters by the applicable rules, e.g. in the USA the FCC rules. Thus, the modulation indices must stay within predetermined permitted limits.

THE INVENTION

It is an object of the invention to provide a method and a system for signalling traffic information using amplitude modulation (AM) medium wave transmitters without disturbing the audio signals and receivers operable in the system and by the method.

Another object of the invention is to provide a method and a system for transmitting and receiving additional information e.g. as digital signals by AM medium wave, broadcast band stereo and mono transmitters and receivers.

Briefly, in accordance with the invention, transmission of additional information by AM medium wave broadcasting utilizes:

generation of a sinusoidal signal having a frequency $f_1$, according to the formula $f_1=(m/n)\cdot f_2$, wherein $f_2$ is the frequency of a stereo pilot tone for AM medium wave broadcasting and m and n are unequal integers;

modulation of the phase of the carrier of the AM medium wave being broadcast with the sinusoidal signal and modulating the amplitude of the carrier with an audio signal, forming, for example, a program signal; and transmission of the so-modulated carrier and receiving the carrier (including its side bands). For reception, the phase and amplitude modulated carrier is demodulated and said sinusoidal signal is retrieved from the phase demodulated signal.

There is no separate signal corresponding to the RR signal in the AM traffic information broadcasting method and system of the present invention. A stereo pilot tone (PT signal) is used as an auxiliary carrier.

DRAWINGS

DETAILED DESCRIPTION

Figure 1A:
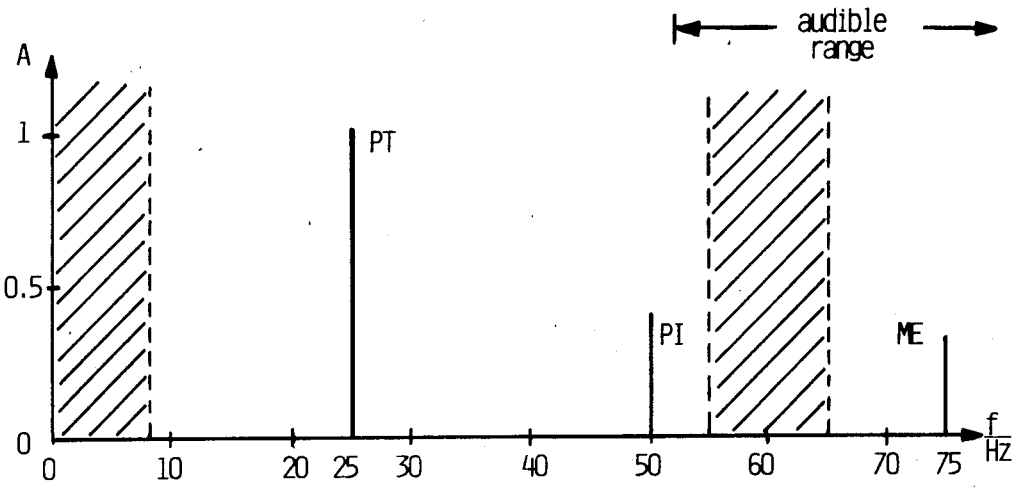
FIG. 1A shows a spectrum of signals according to one variant the invention.
Figure 1B:
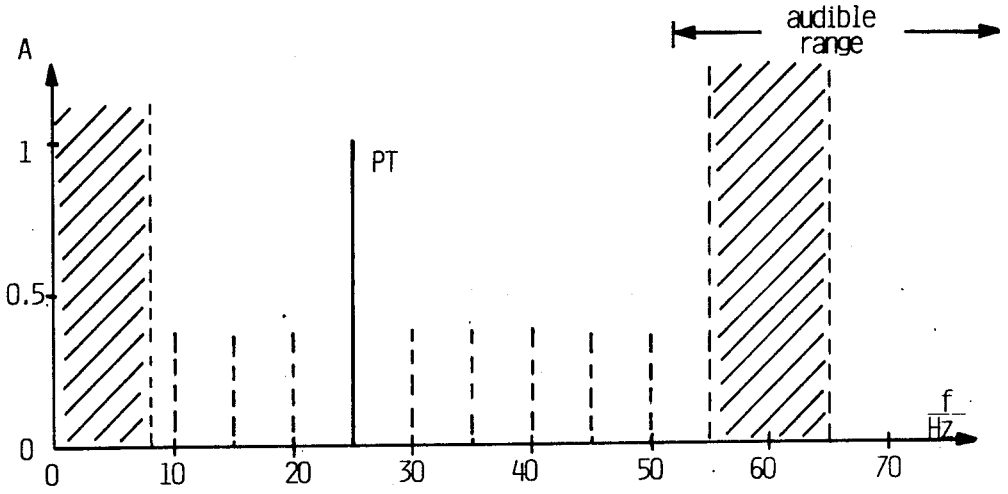
FIG. 1B shows a spectrum of signals according to another variant of the invention, FIGS. 2A and B are a block diagram of a circuits for generating the stereo pilot tone and sinusoidal signals according to the invention.

FIGS. 1A and 1B show frequency spectrums demonstrating the aspects and objects of the invention relating to compatibility with existing AM medium wave broadcast systems. Both diagrams show the lower part of the frequency range of the base band of the (L-R) signal of an AM medium stereo system with additional signals superimposed according to the invention. A is the relative amplitude of the signals referred to the amplitude of the stereo pilot tone PT.

Frequencies lower than 7.5 Hz are not usable for the transmission of additional signals because of the lower cut-off frequency of the amplifiers to be used. Furthermore, frequencies close to the power mains frequency are to be avoided. The corresponding areas FIGS. 1A and 1B are hatched. The lines at 25 Hz represent the stereo pilot tone PT. The audible range begins at about 50 Hz and is labelled by arrows.

Before referring to FIGS. 1A and 1B in detail some further aspects of compatibility and compliance with FCC rules shall be explained in view of the choice of the additional signals:

- the additional signals as well as the stereo pilot tone have to be transmitted outside the audio frequency range;
- the injection of the additional signals must not affect the spectrum of the broadcast high frequency signal;

the sum of the additional signals and the stereo pilot tone must not have an instantaneous amplitude value higher than the amplitude of the stereo pilot tone (so that the modulation index may remain the same).

Besides this, the additional signals have to be transmitted without severe disturbances and must be capable of being easily separated from the transmitted signal mixture. All these pre-conditions are satisfied by the method and system according to the invention.

Referring now to FIG. 1A the additional signals PI (program identification) and ME (message), corresponding to the AR signals are transmitted as sinusoidal signals with frequencies of 50 Hz and 75 Hz. The relative amplitude A is between 0.3 and 0.4 referred to the amplitude of the stereo pilot tone. The resulting amplitude does not increase more than allowed if the phase relations between PT, PI, and ME are chosen suitably. As an example: the third harmonic is superimposed to the fundamental in phase, i.e. both have a positive crossover at the same time, the peak amplitude of the resulting signal is lower than that of the fundamental. Superimposing an even-numbered harmonic the positive and negative peak amplitudes can have different values. Therefore it can be useful to add a DC component in order to utilize the allowed maximum amplitude.

As shown in FIG. 1A the signal ME has a frequency within the audio range. This is a compromise between some of the pre-conditions mentioned above. But the signal ME is not transmitted permanently but only during traffic information, when normally the stereo pilot tone and the (L−R) channel are switched-off. If the traffic information should be transmitted in stereo the disturbances would be tolerable due to the small amplitude of ME. Instead of or in addition to the harmonics of the stereo pilot tone frequency the sub-harmonics can be used for additional signals.

In the spectrum shown in FIG. 1B the frequencies of the additional signals differ from the frequency of the stereo pilot tone PT by a factor m/n, whereby m and n are different integers and n is greater than 1. For n=5 the frequencies are spaced by 5 Hz as shown in FIG. 1B. Possible frequencies for the additional signals are indicated by dashed lines.

Figure 2A:
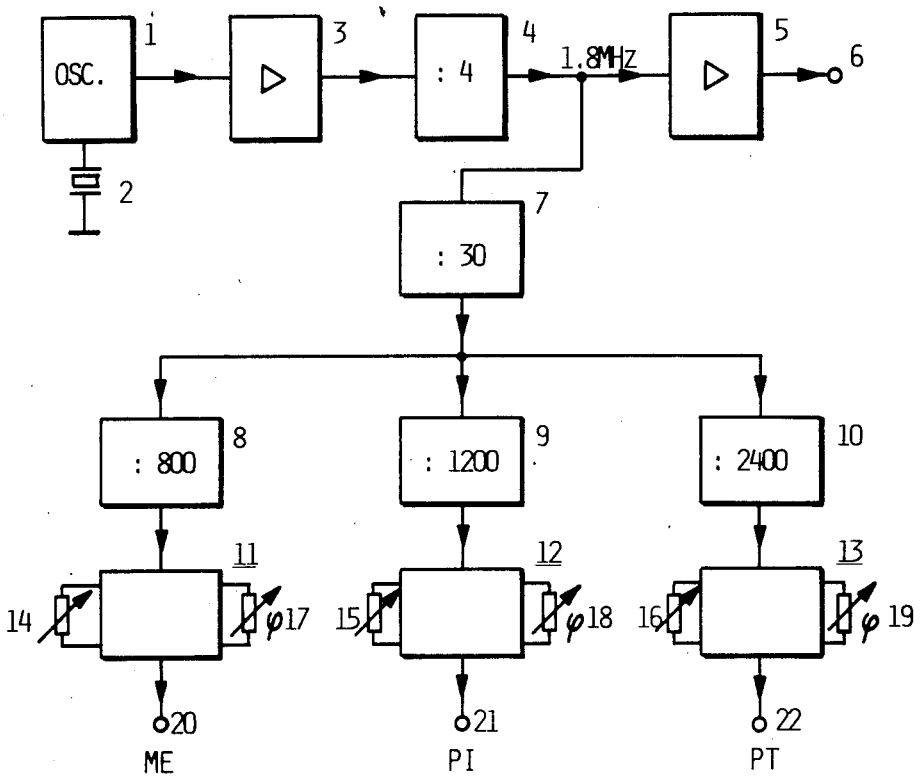
FIG. 2C is a block diagram of a circuit for generating sinusoidal signals according to the invention for system where a stereo pilot tone is already generated by another circuit.
Figure 3:
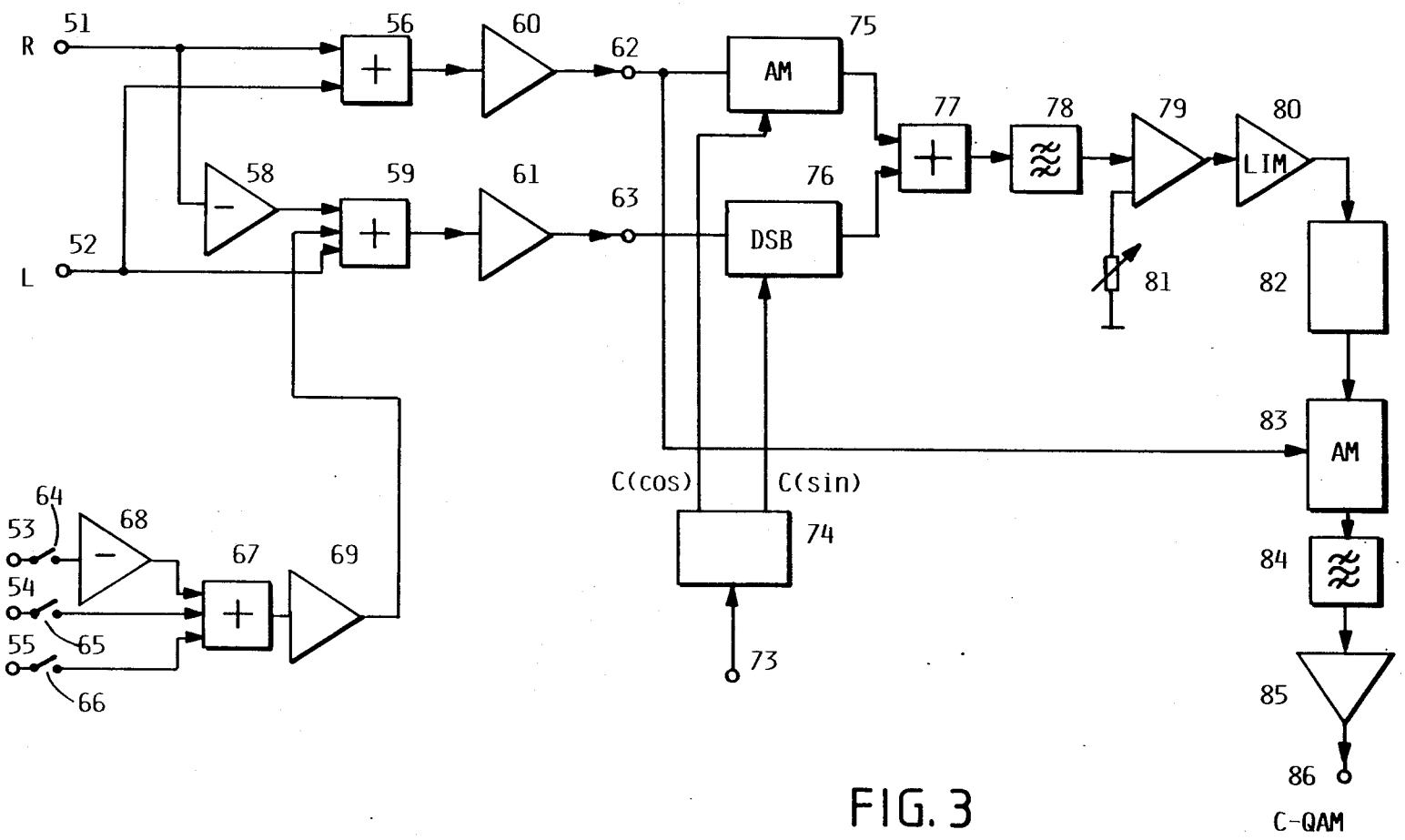
FIG. 3 shows a schematic block diagram a transmitter exciter adapted for the use according to the invention.

In the circuit shown in FIG. 2A an oscillator generates a signal with a frequency of 7.2 MHz stabilized by a quartz 2. After passing a separating amplifier 3 the frequency of the signal is divided by four by means of the frequency dividing circuit 4. This results in a frequency of 1.8 MHz, which is four times higher than the intercarrier required by the modulating circuit of FIG. 3. The output signal of the frequency dividing circuit 4 passes the amplifier 5 and is available at the connecting point 6 for the modulating circuit (FIG. 3).

In a next step the frequency of the output signal of the circuit 4 is divided by 30 by means of the frequency divider 7. From the resulting frequency of 60 kHz the frequencies of the signals PT (pilot tone), PI (program identification), and ME (message signal) are derived by further frequency dividing circuits 8, 9, 10.

As the output signals of the frequency dividers have rectangular waveforms they are delivered to output stages 11, 12, 13 which comprise band-pass filters for the frequencies involved, phase and amplitude adjustment means and output amplifiers. The amplitudes of the signals can be adjusted by potentiometers 14, 15, and 16. The phases can be adjusted by potentiometers 17, 18, and 19. From the outputs 20, 21, and 22 the signal PT, PI, and ME can be taken to a modulating circuit as shown in FIG. 3.

The embodiment according to FIG. 2B uses an 6-bit counter 26 and a PROM 27 (programmable read-only memory) as frequency divider. A clock signal with a frequency of 1.5 kHz is applied to the input 25. It can be generated by a quartz oscillator directly or by dividing a higher frequency similar to the circuit shown in FIG. 2A. The six outputs of the counter 27 are connected to six of ten address inputs A0 to A9 of the PROM 27. The PROM 27 has eight outputs Q0 to Q7. The outputs Q0, Q2 and Q4 are connected through amplifiers 30, 31, and 32 and band-pass filters 33, 34, and 35 with the outputs 36, 37, and 38 of the circuit. The output Q7 is connected with the reset input of the counter 26.

Each clock pulse causes the counter 26 to increase the value at its outputs (a six digit binary number) by one. When this value reaches 60 the value at Q7 changes—according to the data stored in the PROM—and the counter becomes reset to zero, see pulse diagram, graph Q7.

As shown in the pulse diagram, from the counting values N=1 to 30 the level at the output Q4 e.g. is "H" and from 31 to 60 "L", see graph PT. The level of output Q2 is "H" from 1 to 15 and from 31 to 45 and "L" from 16 to 30 and from 46 to 60, see graph PI. Finally, the output Q0 has the level H from 1 to 10, 21 to 30, and 41 to 50 and the level L from 11 to 20, 31 to 40, and 51 to 60, see graph ME.

The square wave signals generated in this way are amplified and then converted to sinusoidal signals by the band-pass filters 33, 34, 35 for 25 Hz, 50 Hz, and 75 Hz. The signals PT, PI, and ME can be taken from the outputs 36, 37, and 38 for further use. The remaining address inputs A6 to A9 of the PROM can be used e.g. to shift the phases of the signals RE and/or PI in relation to PT if required. For this purpose the inputs 28, 29, 29*a*, and 29*b* of the circuit have to be connected with H or L levels.

As mentioned above another object of the invention is to transmit additional information as digital signals. This can be done by phase modulating a sinusoidal signal e.g. the signal PI. A very simple possibility to achieve such a phase modulation is to store such data in the PROM that PI corresponds to H and L resp. as mentioned above if one of the inputs A6 to A9 has a first level (e.g. H). In case of a second level (e.g. L) $PI_p$ may have inverted values resulting in a phase shift of 180°, or, in other words, a phase modulation index of 180°. But any other index is possible by storing different data in the PROM 27. Of course the clock frequency of the digital signal applied to A6, A7, A8, or A9 has to be essentially lower than the frequency of PI. In some cases it may be advantageous to modulate the amplitude of the signal PI with a digital signal. This can be done easily by a known amplitude modulator and is not shown in the drawings.

Figure 2C:
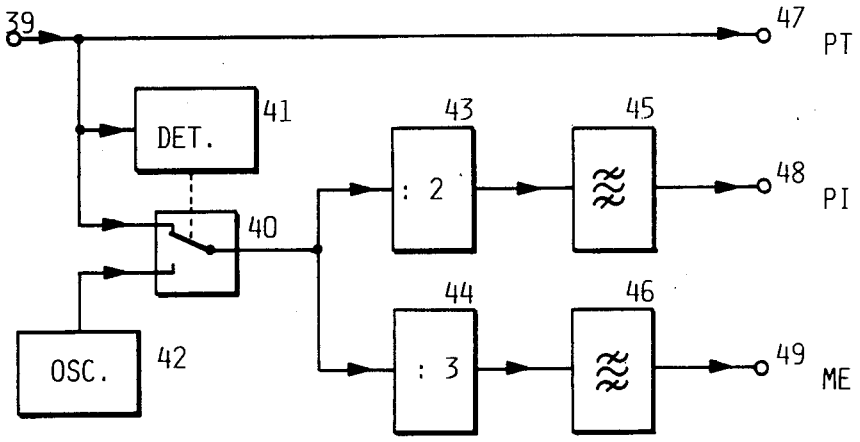

A circuit as shown in FIG. 2C is usable if in an existing system the stereo pilot tone PT is already generated. The input 39 is supplied with such pilot tone, which is delivered to a switch 40 and an amplitude detector 41. As long as the pilot tone is present the switch is in the upper position. The pilot tone travels to the output 47 and to the frequency multipliers 43 and 44 by means of which square wave signals of 50 and 75 Hz are generated which again become sinusoidal by the band-pass filters 45 and 46. The signals PT, PI, and ME can be taken from the outputs 47, 48, and 49.

During monoaural transmissions the stereo pilot tone PT fails. Then the amplitude detector 41 puts the switch 40 into the lower position. In order to generate the signals PI, and ME a supplemental pilot tone is obtaining from an oscillation generator 42 and the circuit according to FIG. 2C delivers the signal PI, and ME only.

The circuit shown in FIG. 3 comprises inputs 51, 52 for the left (L) and right (R) channel of stereo signals to be transmitted. Further inputs 53, 54, 55 are provided for the signals ME, PI, and PT.

As usual at stereo broadcasting the signals L and R are added to form a signal which is compatible with the mono broadcasting signal. In addition to the signal L+R a signal L−R is transmitted. The sum is derived by an adding circuit 56 to which the signals L and R are delivered from the inputs 51, 52.

For deriving the signal L−R the signal R passes an inverting amplifier 58 before entering the adding circuit 59 together with the signal L. The signals L+R and L−R pass from the output of the respective adding circuit 56, 59 through an amplifier 60, 61 each to the outputs 62, 63 of the amplifiers 60, 61.

According to the invention besides the signal PT the signals PI and ME are added to the L−R signal. For this purpose the signals ME, PI, and PT are delivered from the inputs 53, 54, 55 through switches 64, 65, 66 to inputs of an adding circuit 67, whereby the signal ME is inverted by the inverting amplifier 68. The output of the adding circuit 67 is connected to the input of an amplifier 69 the gain of which is adjustable in order to adjust the amplitude of the signal PT+PI−ME.

From the output of the amplifier 69 the signal PT+PI−ME is taken to a third input of the adding circuit 59, the output signal of which comprises the components L, −R, PT, PI, and −ME.

The quadrature modulator has an AM modulator for the L+R signal, and a double side band modulator for the signal comprising L, −R, PT, PI, and −ME.

A 1.8 MHz carrier signal is delivered from the input 73 to a counting device 74. Counter 74 is a Johnson counter which produces two square-wave signals having a frequency of one fourth of the input signal and having a phase difference of 90° from one another. As the input frequency is 1.8 MHz the output signals have a frequency of 450 kHz. In the drawing these signals are labelled as C(sin) and C(cos).

The carrier C(cos) is amplitude modulated with the L+R signal by means of the amplitude modulator 75, whilst the carrier C(sin) is modulated with the signal (L−R+PT+PI−ME) by means of the double side band modulator 76.

The output signals of the modulators 75, 76 are added by means of circuit 77. The resulting signal is a quadrature amplitude modulated (QAM) signal having a rectangular waveform. A band-pass filter 78 with a bandwidth of 30 kHz suppresses the harmonics of the carrier frequency so that the output signal of the band-pass filter is sinusoidal.

The circuits described in the following convert the QAM signal into a C-QAM signal. An amplifier 79 and a limiter 80 serve as square wave former. The limiter 80 has an amplitude window which is very small compared with the amplitude of the sinusoidal QAM signal. Therefore it "cuts" a very thin slice out of the QAM signal. A potentiometer 81 associated with the amplifier 79 enables the adjustment of the DC component of the output signal of the amplifier 79 and also the pulse width of the resulting square wave.

After further treatment of the square wave signal by a signal shaper 82 the signal is delivered to a second amplitude modulator 83 where it becomes amplitude modulated with the L+R signal. A second band-pass filter 84 suppresses the harmonics in order to form a sinusoidal C-QAM signal which is amplified by the amplifier 85 and delivered to the output 86 of the transmitter exciter.

The circuits of the transmitter exciter can be realized very easily by using integrated circuits and few additional components like feedback and biasing resistors. E.g. elements 56, 67, 68, and 69 can be realized by one integrated circuit comprising four operational amplifiers. Another one of the same type (e.g. MC 4741) can serve as elements 58, 59, 60, and 61.

Figure 4:
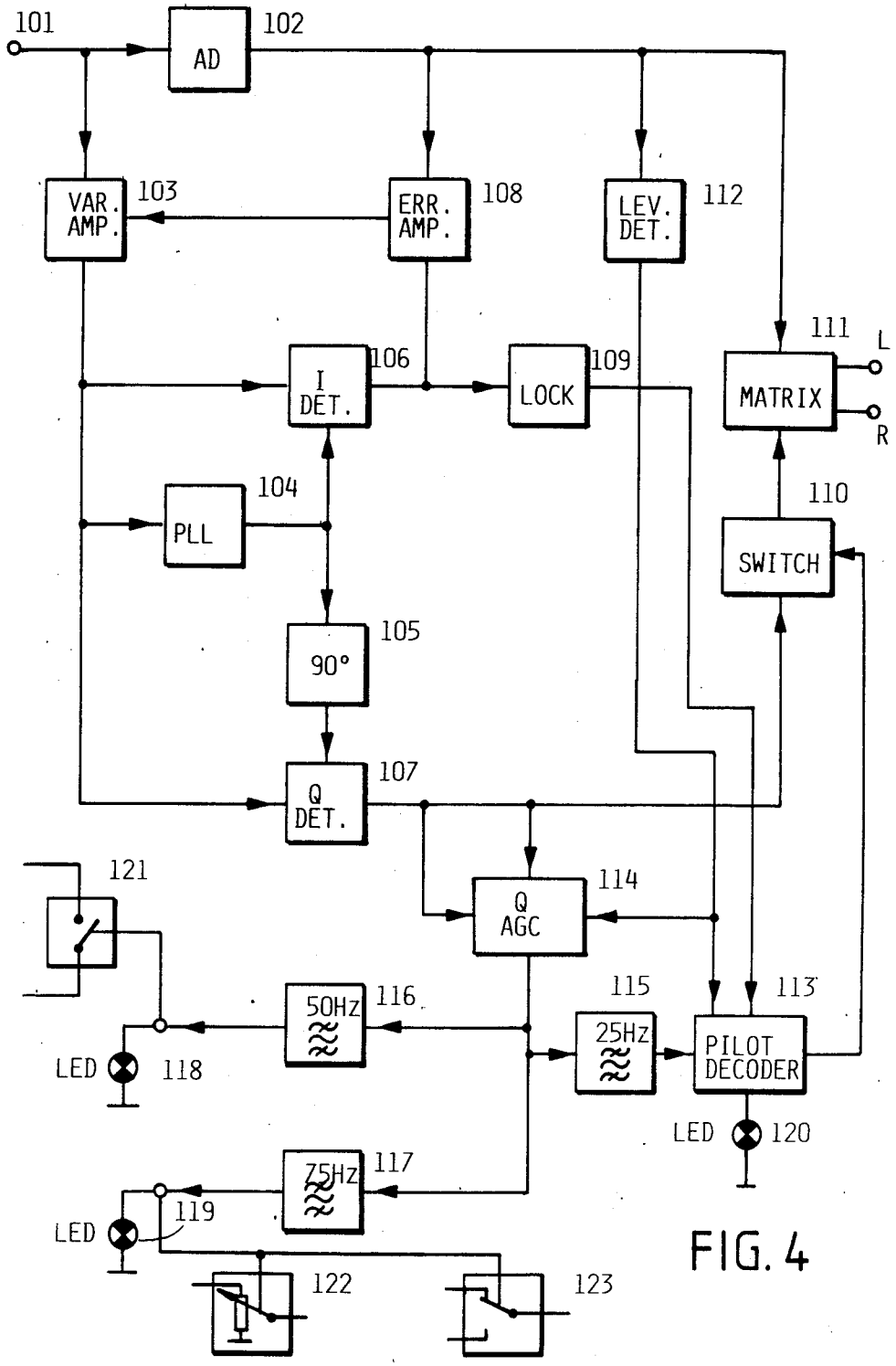
FIG. 4 shows an AM medium wave stereo decoder adapted for the use according to the invention.

FIG. 4 is a block diagram of a C-QAM decoder an AM stereo receiver with the capability to reproduce the sinusoidal signals transmitted according to the invention. The input 101 of the circuit receives the C-QAM signal from IF amplifier (not shown) of the receiver. On the one hand the C-QAM signal is amplitude demodulated by an envelope demodulator 102, on the other hand the C-QAM signal is delivered through a variable gain amplifier 103 to a quadrature demodulator consisting of a PLL circuit 104, a phase shifter 105 and two synchronous demodulators 106, 107.

The PLL circuit 104 regenerates a carrier which is delivered to the synchronous demodulator 106 directly and through the phase shifter 105 to the synchronous demodulator 107. In this way two rectangular components are demodulated separately. The output signal of the synchronous demodulator 106 is compared with the output signal of the envelope demodulator 102 by means of the error amplifier 108 the output of which is connected to a control input of the variable gain amplifier 103.

The output signal of the synchronous demodulator 106 is further delivered to the circuit 109.

The output signal of the synchronous demodulator comprises the components L−R, PT, PI, and ME and travels through a switch 110 to one input of the matrix circuit 111. Another input thereof is supplied with the signal L+R from the envelope demodulator 102. As known in the Art the stereo reproduction is switched down to mono if the level of the received signals falls below a minimum value. Therefore a level detector 112 is connected to the output of the envelope detector 102. The level detector 112 controls the pilot decoder 113, which again controls the switch 110, and the automatic gain control circuit 114.

The output signal of the automatic gain control circuit comprises the signals PT, PI, and ME the frequencies of which are 25, 50, and 75 Hz. The stereo pilot tone is separated by a band-pass filter 115 and delivered to the pilot decoder 113.

The program identification signal PI and the message signal ME are separated by band-pass filters 116 and 117. In the preferred embodiment shown in FIG. 4 two LED indicators 118 and 119 are supplied with the signal PI and ME. This is only to demonstrate that the information transmitted by these signals reaches the user i.e. the car driver in case of a traffic information system. As known from the traffic information systems mentioned above the signal PI can be used to switch-on the audio channel of a car radio if the car driver meets a station with traffic information service when tuning his radio, as indicated by a switch 121. The signal ME can be used to increase the volume or to switch-over from tape reproduction to receiving the station which provides traffic information service when a message regarding the road traffic is transmitted. For increasing the volume a controllable potentiometer 122 and for switching-over from tape to receiving the station a switch 123 can be used.

As usual an LED indicator 120 can be attached to the pilot decoder 113 to indicate stereo broadcasting. The circuit according to FIG. 4 can easily be formed by the integrated circuit MC 13020, exteral circuitry recommended by the manufacturer of the integrated circuit, and two additional band-pass filters for 50 and 75 Hz.

We claim:

1. Method for signalling information, in an amplitude modulated (AM) medium wave broadcasting system, in addition to audio information, comprising generating an amplitude modulation medium wave broadcast carrier;

amplitude modulating the carrier with audio signals;

generating a stereo pilot tone having a frequency $f_{PT}$ below the audible range;

generating a first sinusoidal signal having a frequency $f_1$ according to the formula:

$f_1=(m_1/n)\cdot f_{PT}$;

generating a second sinusoidal signal having a frequency $f_2$ according to the formula:

$f_2=(m_2/n)\cdot f_{PT}$, wherein n is an integer;

$m_1$ is an integer other than n; and $m_2$ is an integer other than n and $m_1$, modulating the carrier with said stereo pilot tone in the range of a predetermined permitted modulation index, modulating the carrier with said first and second sinusoidal signals with amplitudes which, when added, do not essentially exceed the amplitude of the stereo pilot tone which is being modulated on the carrier, and wherein the phases of the first and second sinusoidal signals are different.

2. Method according to claim 1, wherein $n=1$; $m_1=2$; $m_2=3$, and the respective amplitudes and phases of the first and second sinusoidal signals are:

first sinusoidal signal, amplitude 40% of pilot tone, phase 0°;

second sinusoidal signal, amplitude 30% of pilot tone, phase 180°.

3. Method according to claim 1, wherein the proportion of amplitudes of the stereo pilot tone and the first and second sinusoidal signals is approximately:

1:0.4:0.3.

4. Method according to claim 1, wherein the phases of the first and second sinusoidal signals are, respectively, 0° and 180° with respect to the phase of the pilot tone.

5. Method according to claim 1, including generating a sum left-and-right signal (L+R) and a difference signal (L−R), and wherein said stereo pilot tone and said first and second sinusoidal signals are superimposed on the difference signal (L−R).

6. Method according to claim 1, wherein the first sinusoidal signal is transmitted continuously in order to indicate that the transmitter transmits from time to time special information, and the second sinusoidal signal is transmitted during transmission of the special information.

7. Method according to claim 1, including receiving the carrier and audio modulations thereon, and said first and second sinusoidal signals, and a stereo pilot tone;

including separating said first sinusoidal signal and said second sinusoidal signal from the signals representing the audio signals and the stereo pilot tone; and utilizing the so-separated signals, separately, to derive information.

8. Method according to claim 1, wherein one of said sinusoidal signals is modulated with a digital signal by at least one of:

phase modulation;

amplitude modulation.

9. Method for signalling information, in an amplitude modulated (AM) medium wave broadcasting system, in addition to audio information, comprising generating an amplitude modulated medium wave broadcast carrier;

amplitude modulating the carrier with an audio signal;

generating a first sinusoidal signal having a frequency $f_1$ which is below the audible frequency according to:

$f_1=(m/n)\cdot f_2$;

generating a second sinusoidal signal having a frequency $f_2$, wherein the frequency $f_2$ is a sub-audible frequency, and m and n are unequal integers, amplitude modulating the second sinusoidal signal on the broadcast carrier in the range of a predetermined permitted modulation index and a phase of 0°;

modulating the phase of the carrier of the amplitude modulated medium wave being broadcast with the first sinusoidal signal;

modulating the amplitude of the carrier with an audio signal;

controlling the amplitude and phase of the first and second sinusoidal signals such that the maximum instantaneous value of the sum of said first and second signals will not exceed the maximum value of said second sinusoidal signal alone;

transmitting the so-modulated carrier;

receiving the carrier including the side bands; and demodulating the phase and amplitude modulated carrier, and selecting said first and second sinusoidal signals from the phase and amplitude demodulated signals.

10. Method according to claim 9, wherein said first sinusoidal signal is modulated with a digital signal.

11. Method according to claim 10, wherein the phase of said first sinusoidal signal is modulated with said digital signal.

12. Method according to claim 10, wherein the amplitude of said first sinusoidal signal is modulated with said digital signal.

13. In a system of signalling by radio transmission, said system utilizing an amplitude modulated medium wave broadcasting signal, and providing for transmission of information additional to audio information which is amplitude modulated on a medium wave broadcast carrier, means to generate a stereo pilot tone in a subaudible frequency range, means to generate a first sinusoidal signal having a frequency which is an integer multiple of an integer fraction of the frequency of the stereo pilot tone;

means to generate a second sinusoidal signal which is a different integer multiple of the integer fraction of the frequency of the stereo pilot tone than said first sinusoidal signal means to add said first and second sinusoidal signals, said pilot tone, and the difference of left and right stereo signals to form a sum, means to modulate a carrier with said sum using C-QAM modulation to form a composite signal;

means to radiate said composite signal;

a receiver for receiving the composite radiated signal comprising means for demodulating the amplitude of the carrier;

means for demodulating the phase of the carrier;

and a plurality of frequency selective means connected to the output of said phase-of-carrier demodulating means, said frequency selective means being tuned, respectively, to the frequency of the stereo pilot tone and, respectively, to frequencies which are different integer multiples of an integer fraction of the frequency of the stereo pilot tone, and correspond to the respective frequencies of the first and second sinusoidal signals.

14. Receiver according to claim 13, wherein said means for demodulating the amplitude and said means for demodulating the phase of said carrier form a C-QAM decoding circuit arrangement.

15. Receiver according to claim 13, wherein the output of one of said frequency selective means is connected to at least one of;

the volume control means (122) of a car receiver;

a display device (118, 119) in a car receiver;

a control input of an audio switch-over device (123).

16. Receiver according to claim 13, wherein the frequency of the first sinusoidal signal is twice the frequency of the stereo pilot tone for AM medium wave broadcasting, and the frequency of the second sinusoidal signal is three times the frequency of said stereo pilot tone.

17. Receiver according to claim 16, wherein said means for demodulating the amplitude and said means for demodulating the phase of said carrier form a C-QAM decoding circuit arrangement.

18. Receiver according to claim 16, wherein the output of one of said frequency selective means is connected to the volume control means (122) of a car receiver.

19. Receiver according to claim 16, wherein the output of at least one of said frequency selective means is connected to a display device (118, 119) in a car receiver.

20. Receiver according to claim 16, wherein the output of one of said frequency selective means is connected to a control input of an audio switch-over device (123).

21. In the system of claim 13, a transmitter for generating and radiating said composite signal, comprising means for generating a broadcast carrier signal;

means for modulating the amplitude of the carrier with an audio signal;

means for generating a stereo pilot tone at a subaudible frequency;

means for generating a first sinusoidal frequency which is an integer multiple of an integer fraction of the frequency of the stereo pilot tone;

means for generating a second sinusoidal frequency which is an integer multiple, different from the integer multiple of said first sinusoidal frequency, of an integer fraction of the frequency of the stereo pilot tone;

means for adding said first and said second sinusoidal signals;

a C-QAM modulator, and an adding circuit for adding the sum of said sinusoidal signals and said stereo pilot tone to the difference signal of the left-and-right signal of a stereo AM signal being radiated by the transmitter; and means for modulating the phase of the carrier with said added sinusoidal signals.

22. The system of claim 21, wherein the means for generating said first sinusoidal signal generate said signal at a frequency twice the frequency of the stereo pilot tone;

and wherein the means for generating the second sinusoidal signal generate a frequency of three times the frequency of the stereo pilot tone.

23. The system of claim 21, wherein said means for radiating the signal transmits said first sinusoidal signal and said second sinusoidal signal in addition to said stereo pilot tone, and wherein the respective means generating said respective sinusoidal signals provide said signals at an amplitude which is smaller than the amplitude of the stereo pilot tone and in a proportion of about 1:0.4:0.3 of stereo pilot tone, first, and second sinusoidal signals.

* * * * *